US006193227B1

(12) United States Patent
Boss

(10) Patent No.: US 6,193,227 B1
(45) Date of Patent: Feb. 27, 2001

(54) CONTINUOUSLY FEEDING SHEETS WITH COIL UNWIND CONTROL

(75) Inventor: Heinz Boss, Strengelbach (CH)

(73) Assignee: Grapha-Holding AG, Hergiswil (CH)

( * ) Notice: Subject to any disclaimer, the term of this patent is extended or adjusted under 35 U.S.C. 154(b) by 0 days.

(21) Appl. No.: 09/063,751

(22) Filed: Apr. 21, 1998

(30) Foreign Application Priority Data

Apr. 28, 1997 (CH) ..... 0980/97

(51) Int. Cl.[7] ..... B65H 39/14; B65H 29/66

(52) U.S. Cl. ..... 270/52.12; 270/52.07; 271/184; 271/186; 271/225; 271/270; 271/275; 226/172; 242/558; 242/563; 242/528; 242/564.5

(58) Field of Search ..... 270/52.07, 52.08, 270/52.09, 52.11, 52.12; 226/118.1, 118.5, 172; 242/558, 563, 564.5, 528; 271/225, 275, 184, 186, 270

(56) References Cited

U.S. PATENT DOCUMENTS

| | | | | |
|---|---|---|---|---|
| 4,595,192 | * | 6/1986 | Reist | 271/184 |
| 4,684,118 | * | 8/1987 | Boss et al. | 270/58 |
| 4,953,843 | * | 9/1990 | Reist | 271/3.1 |
| 5,088,711 | | 2/1992 | Newsome . | |
| 5,295,679 | * | 3/1994 | Reist | 271/182 |
| 5,443,254 | * | 8/1995 | Reist | 271/225 |
| 5,673,869 | * | 10/1997 | Honegger | 242/528 |
| 5,846,835 | * | 12/1998 | Sisbarro et al. | 436/166 |

FOREIGN PATENT DOCUMENTS

| | | |
|---|---|---|
| 3532403 | 4/1986 | (DE) . |
| 0300179 | 1/1989 | (EP) . |

* cited by examiner

*Primary Examiner*—Christopher P. Ellis
*Assistant Examiner*—Patrick Mackey
(74) *Attorney, Agent, or Firm*—Friedrich Kueffner

(57) ABSTRACT

A method of and an apparatus for feeding a processing machine with flat products, such as printed sheets, cards, patterns or the like. Over a conveyor path arranged between a storage unit and the processing machine and forming a product storage unit, the flat products are carried from the storage unit in a stream formed by products arranged in an overlapping configuration. The product stream conveyed on the conveyor path toward the processing machine is followed by a product stream having a higher speed. The apparatus includes a device with a drivable storage unit for removing the flat products, wherein the storage unit is connected through a conveyor unit to a processing machine for processing the products. The conveyor unit includes a plurality of separate conveyor elements arranged one behind the other and driven in the same direction, wherein a sensor each is directed to the conveying ends of the conveyor elements, and wherein each sensor is connected to a control unit for changing the discharge speed of the product from the storage unit and/or the conveying speed of the products on the conveyor elements.

20 Claims, 4 Drawing Sheets

FIG. 6
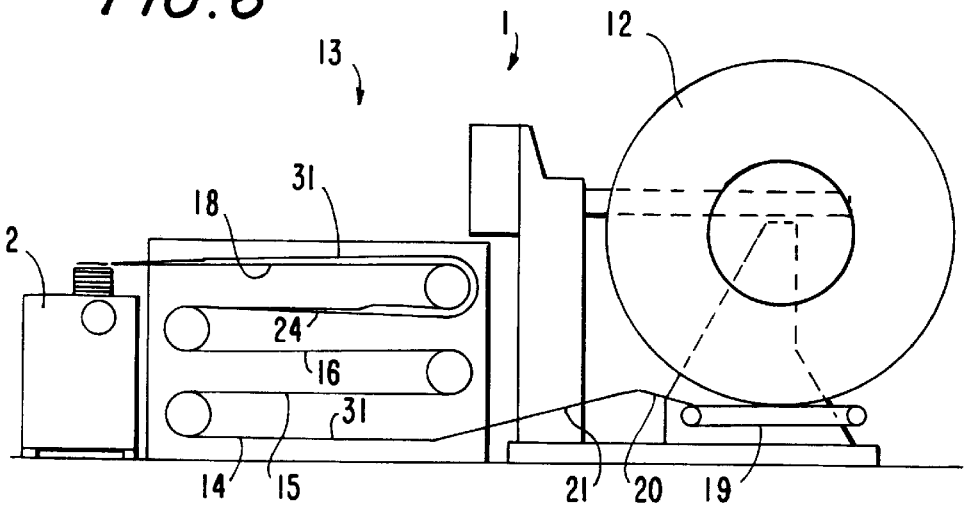
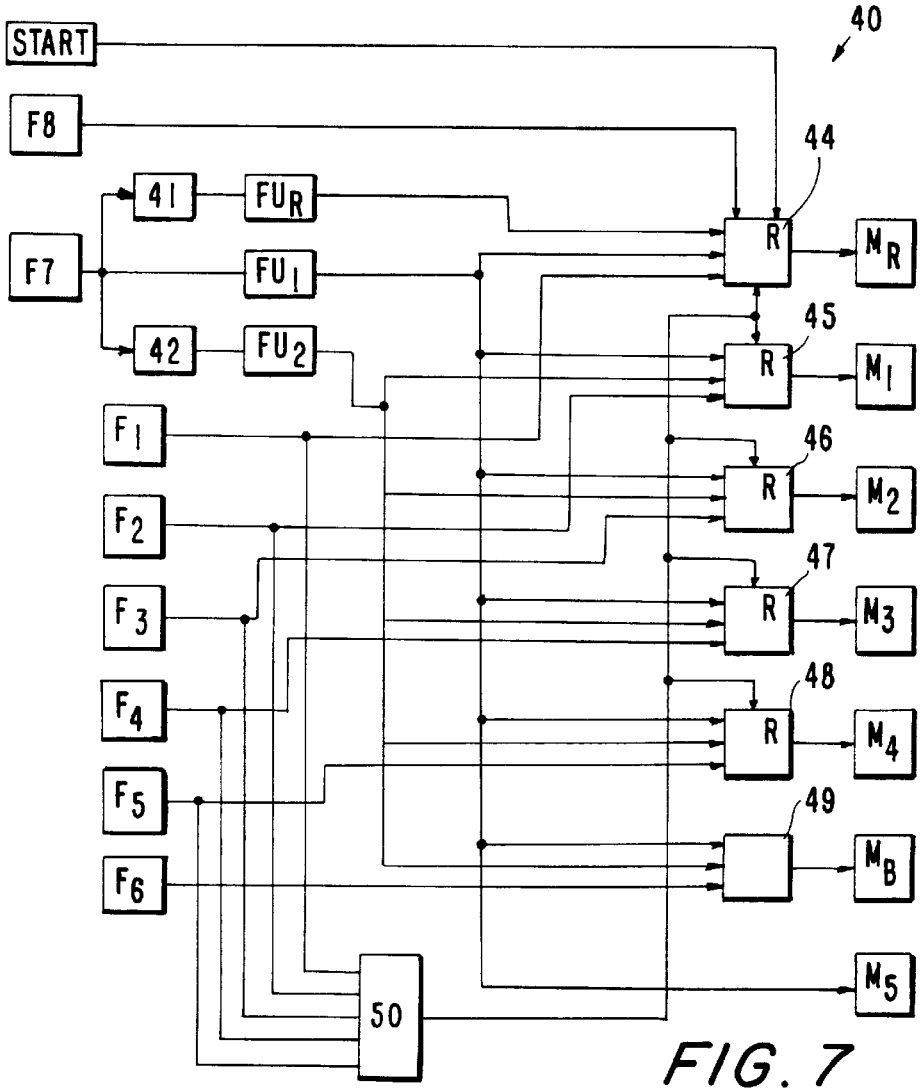
FIG. 7

CONTINUOUSLY FEEDING SHEETS WITH COIL UNWIND CONTROL

BACKGROUND OF THE INVENTION

1. Field of the Invention

The present invention relates to a method of feeding a processing machine with flat products, such as printed sheets, cards, patterns or the like. Over a conveyor path arranged between a storage unit and the processing machine and forming a product storage unit, the flat products are carried from the storage unit in a stream formed by products arranged in an overlapping configuration.

The present invention also relates to an apparatus for carrying out the method.

2. Description of the Related Art

It is known in the art to wind printed products delivered by printing machines or folding machines in a stream formation onto a roll core and to subject them to intermediate storage, so that they can be further processed at a later time.

In a processing machine for such printed products, for example, a gather stitcher or saddle stitcher, the printed products rolled up in the stream formation are again unwound for feeding the gather stitcher in an unwinding station and for transporting the printed products over a relatively short conveyor path to the processing machine, wherein the printed products may have to be turned into a processing position. Single-roller or double-roller stations are available for this purpose.

The single-roller station, which includes one roll, is less expensive and requires less space, however, the station makes it necessary to interrupt the processing machine or gather stitcher when an empty roll core has to be replaced by a new roll. For this reason, the processing machine cannot be utilized in an optimum manner and processing is to a certain extent unproductive.

The double-roller station avoids this disadvantage by making it possible, when a roll is empty, to immediately switch through a switch to a roll which has been prepared in an adjacent area.

However, double-roller stations are expensive and require more space which frequently is not available.

SUMMARY OF THE INVENTION

Therefore, it is the primary object of the present invention to further develop a method and an apparatus of the above-described type in which the disadvantages of the use of a single-roller or double-roller are avoided and the advantages are maintained.

In accordance with the present invention, the product stream conveyed on the conveyor path toward the processing machine is followed by a product stream having a higher speed.

The present invention makes it possible in a simple manner and without harmful effects for the further processing to prevent any difficulties which may be caused by an exchange of a roll of a single-roller station or any other problems which may lead to an interruption of the supply of products at the storage unit or the conveyor path. In other words, it is made possible in a simple manner and without any damage to the further processing to prevent interruptions in the supply of the products.

Moreover, the present invention makes it possible to obtain sufficient time for an exchange of a full roll against an empty roll core to be removed from the rolling station or when an unforeseen interruption occurs in the feeding path of the products to the processing machine; when the roll is to be exchanged, a residual amount of products still present on the roll is fed at a higher speed than the product flow already on the conveyor path, so that the subsequent products form on the conveyor path a more dense product stream; in the event of an interruption in the feeding path, the resulting gap can be at least essentially closed by the subsequently fed product stream in order to be able to maintain the continuity of processing.

The apparatus for carrying out the method according to the present invention includes a device with a drivable storage unit for removing the flat products, wherein the storage unit is connected through a conveyor unit to a processing machine for processing the products. The conveyor unit includes a plurality of separate conveyor elements arranged one behind the other and driven in the same direction, wherein a sensor each is directed to the conveying ends of the conveyor elements, and wherein each sensor is connected to a control unit for changing the discharge speed of the product from the storage unit and/or the conveying speed of the products on the conveyor elements.

The various features of novelty which characterize the invention are pointed out with particularity in the claims annexed to and forming a part of the disclosure. For a better understanding of the invention, its operating advantages, specific objects attained by its use, reference should be had to the drawing and descriptive matter in which there are illustrated and described preferred embodiments of the invention.

BRIEF DESCRIPTION OF THE DRAWING

In the drawing:

FIGS. 3–6 are simplified illustrations, on a smaller scale, showing the apparatus in various phases of operation; and FIG. 7 is a block diagram.

DESCRIPTION OF THE PREFERRED EMBODIMENTS

Figure 1:
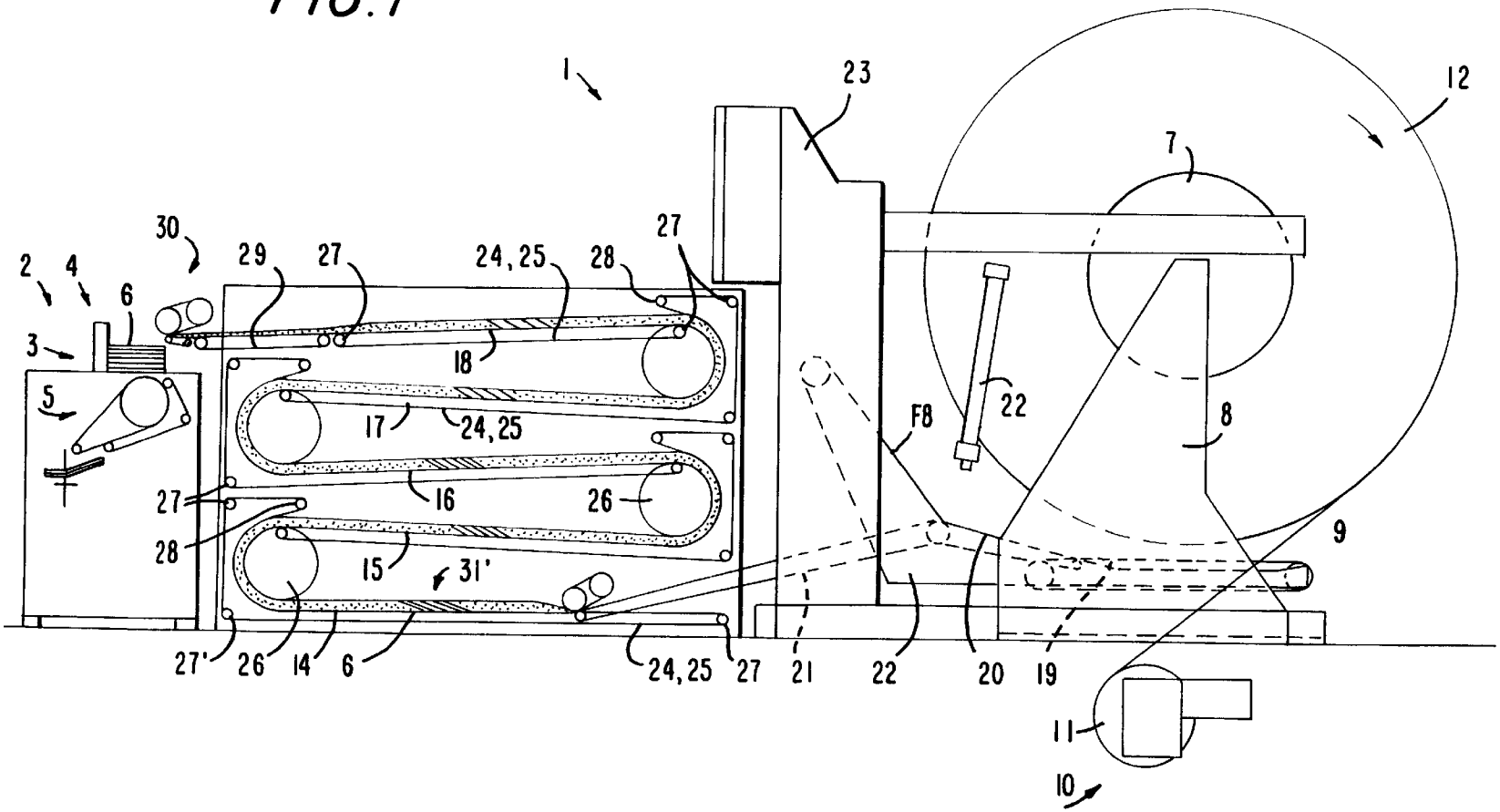
FIG. 1 is a schematic side view of an apparatus according to the present invention.
Figure 2:
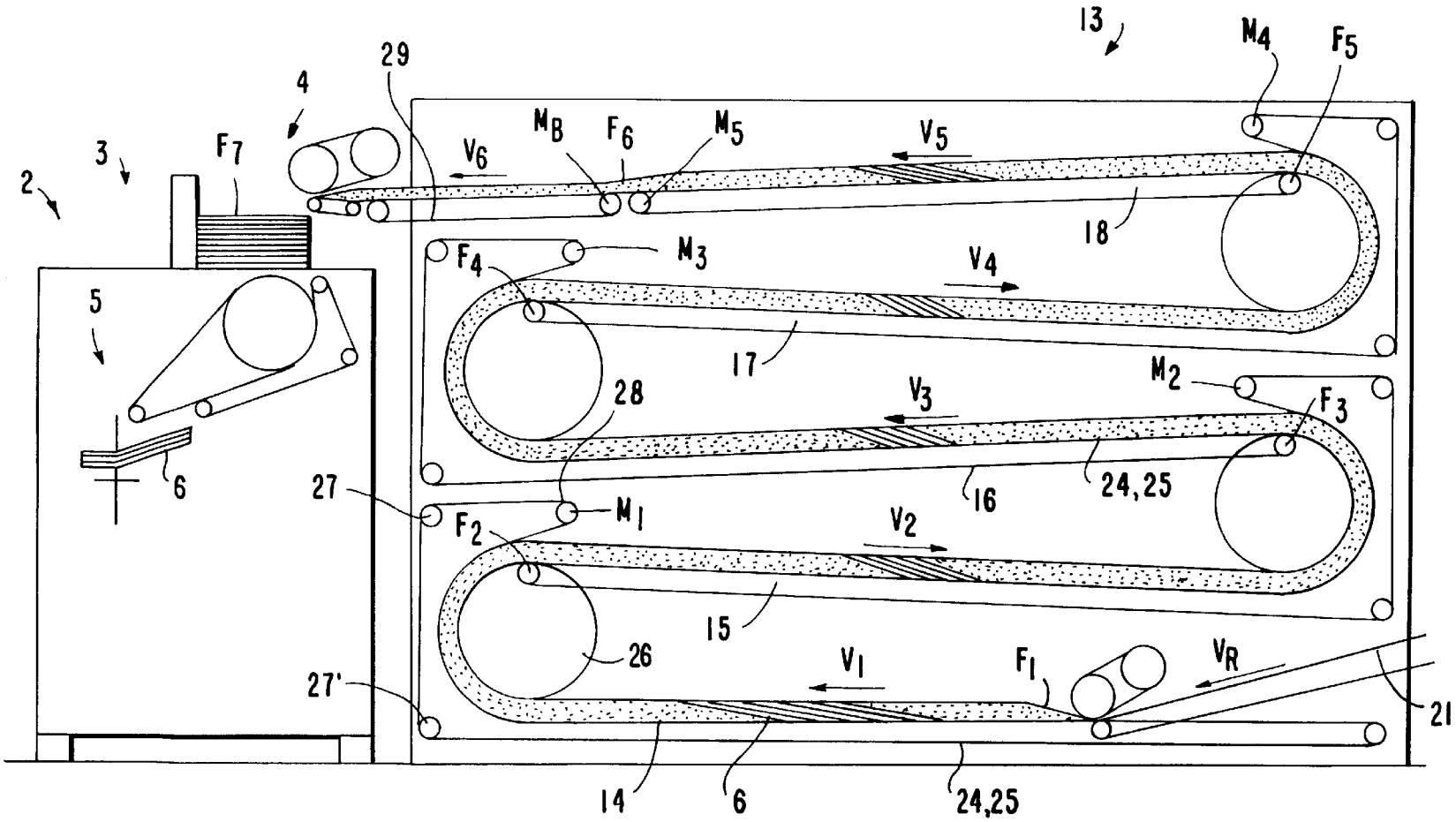
FIG. 2 is a side view, on a larger scale, of a portion of the apparatus of FIG. 1.

FIGS. 1 and 2 of the drawing show an apparatus 1 according to the present invention for feeding a processing machine 2. The processing machine 2 may be, for example, a gathering machine. The drawing shows of the gathering machine a channel-like gathering unit 5 and a stacking magazine 4 belonging to a known feeder 3 and being fed with printed sheets 6.

The printed sheets 6 are made available for processing in a storage unit in the form of a roll 12 and, as also shown in the drawing, are conveyed to the processing machine 12. The roll 12 has a core 7 which is rotatably mounted in a support 8. The layers of the printed sheets 6 present as a stream formation and wound around the core 7 are held on the core 7 by means of winding belts 9, wherein one end of each winding belt 9 is attached to the core 7 and the other end is attached to the roller 11 supported in a belt magazine 10.

Contrary to the illustration in FIG. 1, the belt magazine 10 is mounted on the support or frame 8 and the roller 11 is coupled corresponding to the roll 12 with the drive shaft of a gear motor For conveying the printed products, the processing machine 2 and the roll 12 are connected through a conveyor unit 13, so that when the stream of printed products 6 is unrolled from the roll 12, the printed products reach the first conveyor element 14 as seen in conveying direction, i.e., the first conveyor element 14 of the conveyor elements 14 to 18 forming the conveyor unit 13. The roll 12 may be driven at the axis of the roll core 7, or, as shown in the drawing, with a conveyor belt 19 at its periphery.

Provided for conveying the printed products 6 from the roller 12 are the conveyor belts 19–21 which are usually used for feeding the processing machine 2 directly. The first conveyor belt 19 as seen in conveying direction is placed against the periphery of the roll by means of a lifting element 23 acting on an arm 22. The roll is emptied by means of the driven conveyor belt 19 onto the subsequently arranged conveyor belts 20, 21 which are hinged to the arm 22 in such a way that an unimpeded conveying stream can be produced. The arm 22, in turn, is pivotably mounted on a support 23. A sensor $F_8$ produces a signal when the arm 22 has been lifted to such an extent that the supply of printed products on the roll has been emptied with the exception of a residual quantity.

The printed sheets 6 arriving from the roll 12 are conveyed from the conveyor belt 21 onto the conveyor element 14 which forms the entry of the product storage unit or conveyor unit 13. Prior to reaching the conveyor element 14, the printed sheets 6 may be turned. The product storage unit illustrated in the drawing is composed of five storage sections or conveyor elements 14–18 arranged one behind the other and, for reasons of space, on top of one another.

With the exception of the last conveyor element 18 which extends in a flat conveying plane, the conveyor elements 14–17 are constructed so that the printed sheets 6 are turned at the conveyor end by a deflection. The conveyor elements 14–17 are essentially of equal construction and operate in the same manner, but are driven so as to be individually and commonly controllable.

The conveyor elements 14–17 are formed by two laterally offset endless belts 24, 25 and a guide roller 26 as well as several deflection rollers 27, wherein the belts travel around the rollers so as to form a support for the printed sheets 6. The conveyor elements 14–17 of the illustrated embodiment each have a long flat section and a subsequent essentially circular curved section on which the printed sheets 6 are transported, wherein the flat section is formed by two deflection rollers 27, 27' and the bottom portion of the guide roller 26. The upwardly directed circular section on which the printed sheets 6 are transported is formed inwardly by the guide roller 6 and outwardly by the circular belts 24, 25, wherein the belts 24, 25 subsequently are returned about a guide roller 28 and a deflection roller 27 to the deflection roller 27' so as to form the conveyor end at the flat section of the conveyor element 14.

The end of the conveyor element 14 is followed by the flat section of the second conveyor element 15. The end of the conveyor elements 13 forms the flat conveyor element 18 which is formed of two spaced-apart belts 24, 25 travelling around the deflection rollers 27.

Of course, the longer flat section of a conveyor element 14–18 could in conveying direction of the printed sheet 6 also be arranged following the curved section, which would mean that the first conveyor element 14 would approximately correspond to the illustrated conveyor element 18.

A conveyor belt 29 is provided as a transition from the conveyor unit 13 to the stacking magazine 4, as illustrated in FIGS. 1 and 2. The printed sheets 6 conveyed on the conveyor belt 29 are taken over by an accelerating unit 30.

The conveyor belt 29 is also driven by a separate motor $M_B$.

The drive of the conveyor elements 14–18 can be effected by controllable electric motors $M_1$ to $M_5$ for individual conveyor elements or for several conveyor elements 14–18, wherein the electric motors each act on a guide roller 26 or deflection roller 27 of a conveyor element 14–18.

In accordance with an advantageous feature, always one of the deflection rollers 27 of a conveyor element 14–17 supporting the belts 24, 25 is constructed so as to be resilient, so that streams of printed products having different thicknesses can pass the curved sections of the conveyor elements 14–17.

FIG. 2 shows additional features of the embodiment of the apparatus according to the present invention shown in FIG. 1; these additional features will be described below.

When the conveyor unit 13 has an odd number of deflections, the conveyor unit 13 can be used as a turning unit for changing the position of the printed sheets.

A sensor $F_1$ to $F_6$ each is arranged at the upstream ends of the conveyor elements 14–18. An additional analog sensor $F^7$, for example, a level sensor, is arranged at the machine 2. The sensor $F_7$ controls the motors $M_1$ to $M_5$ and $M_R$ in such a way that during normal operation the winding belt 9, all conveyor belts 19–21 and the conveyor elements 14–18 as well as the conveyor belt 29 have the same speed which is such that the machine 2 can reliably process the supplied stream 31 of printed products.

FIG. 7 shows an embodiment of the control unit 40 for controlling the motors M. The sensor $F_7$ controls a first frequency transformer $FU_1$ whose frequency during normal operation drives all motors $M_1$–$M_5M_R$, $M_B$.

The signal of the sensor is also connected to two additional frequency transformers $FU_R$ and $FU_2$ through two multipliers 41, 42 which multiply the signal by an adjustable factor each. For example, the frequency of these transformers is higher by a factor of five than the frequency of the transformer $FU_1$. As a function of the signals of the sensors $F_1$–$F_8$ and a starting signal, the motors $M_R$, $M_B$ and $M_1$–$M_4$ are fed through a circuit 44–49 each either with the frequency of the transformer $FU_1$ or with the frequency of one of the transformers $FU_R$ or $FU_2$.

Figure 3:
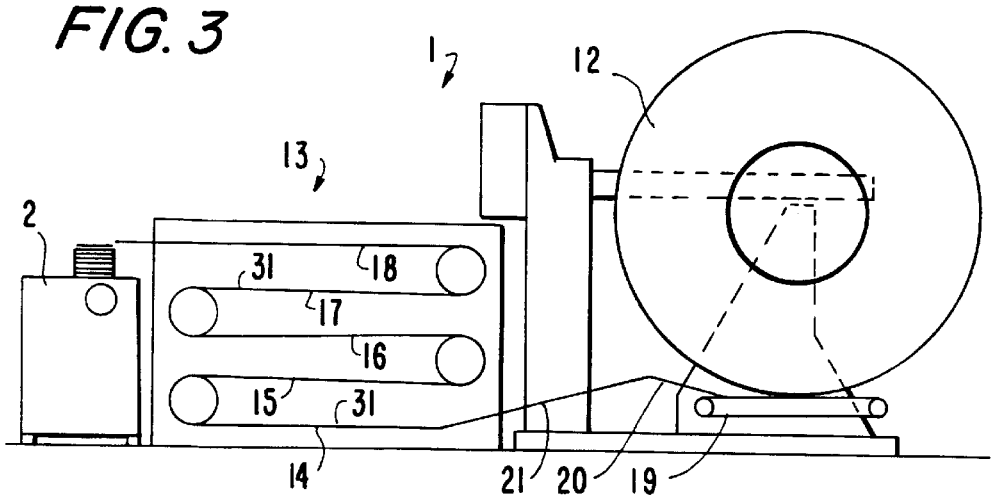

The operation of the apparatus 1 will now be described with the aid of FIGS. 3–6. FIG. 3 shows the normal operation in which all belts travel at the same speed as controlled by the sensor $F_7$. The circuits 44–49 connect all motors M to the transformer $FU_1$. The stream 31 has the same thickness over its entire length.

Figure 4:
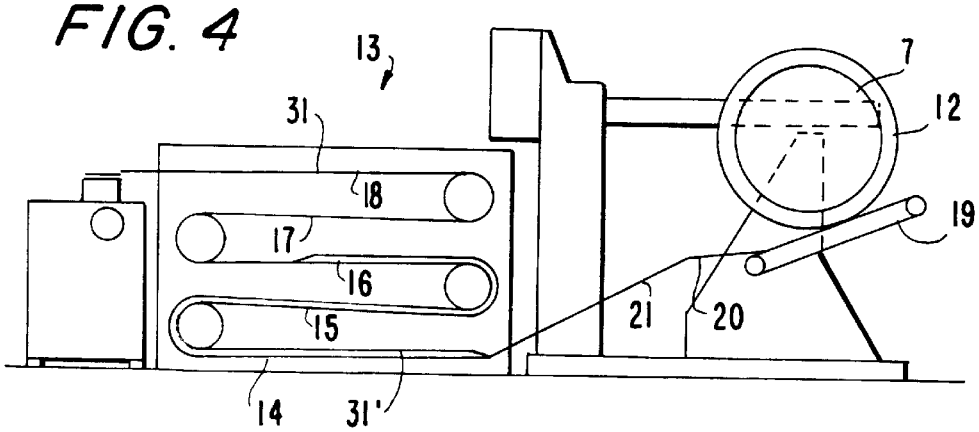
Figure 5:
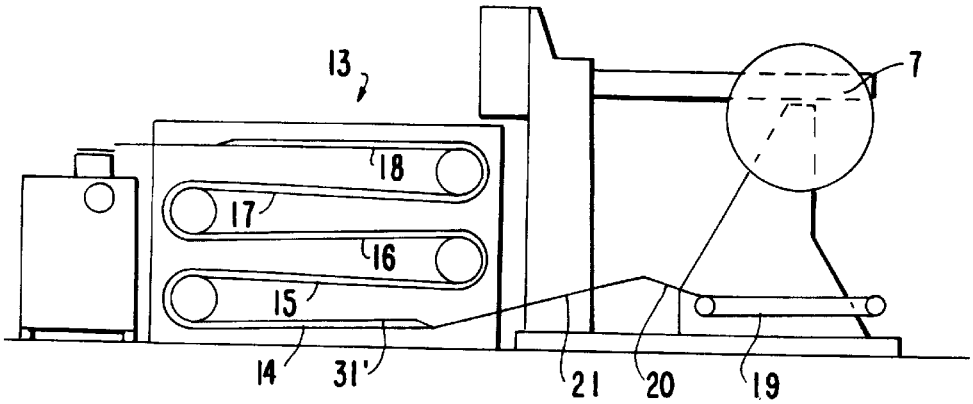

FIG. 4 shows the situation shortly before the end of the supply of products on the roll core 7. For preparing a roll exchange $F_8$ has responded and switched the circuit 44, so that the motor $M_R$ and with it the motors of the belts 19–21 travel, for example, at five times the speed of the remaining belts. Beginning with the lowermost conveyor element 14, a stream 31 is now formed on the conveyor elements 14–18 which has a greater thickness than was the case previously during normal operation. All conveyor elements 14–18 are ideally filled with the thicker stream 31' when the roll core 7 is empty, as shown in FIG. 5.

The sensor $F_1$ now determines the end of the stream 31', switches the motor $M_R$ through the circuit 44 and starts the roll exchange.

As soon as the thicker stream 31' has reached the sensor $F_6$, the $F_6$ switches through the circuit 49 the motor MB to a higher speed, so that the thickness of the stream 31' can be reduced by spreading the printed sheets 6. Since the feeding speed to the stacking magazine is increased, the sensor $F_7$ controls the transformers $FU_1$, $FU_2$, $FU_R$ down by about the same factor, so that the conveyor belt 29 subsequently again travels with the original speed, while the conveyor elements 14–18 travel at a slower speed.

When the end of the thick stream 31 reaches each sensor $F_2$–$F_5$ at the downstream end of the conveyor elements 14–17, the sensors $F_2$–$F_5$ successively switch the respective motors $M_1$–$M_4$ through the circuits 45–48 to the higher frequency of the transformer $FU_2$.

As soon as a new roll 12 has been inserted with its support 6 and the arm 22 has again reached the initial position shown in FIG. 1, the motor $M_R$ is connected through a starting signal to the circuit 44 with the transformer $FU_R$. Accordingly, the belts 9 and 19–21 travel at a higher speed than at least the last conveyor element 18.

Through a logical circuit 20 in which the signals $F_1$–$F_6$ are linked, all circuits 44–48 are returned through a reset input R back into their basic positions as soon as the new thinner stream 31 travels onto a conveyor element 14–18 on which the thicker stream 31' is still present. This logical requirement is such that the circuit 50 produces a reset signal when one of the sensors $F_1$–$F_4$ is switched off when the new stream 31 enters before the next following sensor $F_2$–$F_5$ has been switched on because the thicker stream 31 has left.

When the end of the thicker stream 31' passes the sensor $F_6$, the sensor $F_6$ again switches off, so that the motor $M_B$ is once again connected through the monostable circuit 49 to the transformer $FU_1$ and, consequently, travels at a slower speed. Immediately subsequently, the sensor $F_7$ will respond and the frequency of all transformers will once again be increased toward the original value.

The new thin stream now follows the exiting old stream with only a very small intermediate space which, as a rule, is smaller than the length of a conveyor element 14–18. This makes it possible that the processing machine 2 can be operated practically without interruption during a roll exchange. The conveyor unit 13 or the product storage unit requires a small space and, most importantly, requires no additional space toward the sides, so that it can be easily integrated in existing plants where the available space is limited.

The sensor $F_6$ can also be constructed in such a way that it not only is able to discriminate between thin and thick streams 31, 31' or between the thick stream 31' and zero, but additionally between the thin stream 31 and zero. In that case, the control unit 40 according to FIG. 7 can be modified in such a way that the last conveyor element 18 can also be switched between the two speeds. In this connection, it is possible to connect all motors except $M_B$ once again to the transformer $FU_2$ as soon as the end of the thicker stream 31' has passed the sensor $F_6$. The motors $M_1$–$M_5$ and $M_R$ are then once again switched back to the transformer $FU_1$ when the beginning of the new stream 31 reaches the sensor $F_6$. This makes it possible to keep the interruption of the product stream to the machine 31 extremely short during the roll exchange or any other interruption of the supply.

The invention is not limited by the embodiments described above which are presented as examples only but can be modified in various ways within the scope of protection defined by the appended patent claims.

I claim:

1. A method of feeding a processing machine with flat products, such as printed sheets, cards, patterns, the method comprising feeding the printed products from a storage unit on a conveyor in a stream of products arranged in an overlapping manner, wherein the conveyor is arranged between the storage unit and the processing machine and forms a product storage, further comprising feeding on the conveyor another product stream at a higher speed and following the product stream being fed on the conveyor to the processing machine, further comprising forming the product stream traveling at the higher speed by a residual quantity of products stored in a second storage unit, and feeding the product stream formed by a residual quantity of products to an upstream end of the conveyor, wherein the conveyor is divided into a plurality of conveyor elements which are driveable separately or commonly, further comprising feeding the product stream with the higher speed of another storage unit exchanged against an empty storage unit with a higher speed as compared to the processing speed of the products to an upstream end of a conveyor element.

2. The method according to claim 1, comprising feeding the additional product stream with a higher speed as compared to the processing speed of the products to an upstream end of a conveyor element.

3. The method according to claim 1, comprising changing the speed of successively arranged conveyor elements or of a roll as a function of signals produced by sensors arranged at downstream ends of the conveyor elements.

4. The method according to claim 1, comprising triggering the exchange of the storage unit against another storage unit by a signal of a sensor arranged at an upstream end of a first conveyor element in a conveying direction.

5. The method according to claim 4, comprising changing the increased speed of the conveyor elements and of the storage unit connected to the conveyor elements to the processing speed when the additional product stream has reached an end of the last product stream of a previously emptied storage unit.

6. The method according to claim 1, comprising increasing the speed of the storage unit and the conveyor elements facing the storage unit above the processing speed when a following end of a product stream of a storage unit has passed a downstream end of a conveyor element, and reducing the increased speed to processing speed when a front end of the additional product stream has reached the following end of the preceding product stream.

7. The method according to claim 1, wherein the storage unit comprises at least one exchangeable rotatably driveable multi-layer roll of flat products.

8. An apparatus for feeding a processing machine with flat products, such as printed sheets, cards, patterns, the apparatus comprising a driveable storage unit from which the flat products are removed, a conveyor forming a product storage means connecting the driveable storage unit to the processing machine for processing the products, wherein the conveyor comprises a plurality of separate conveyor elements arranged one behind the other and driven in the same direction, each conveyor element having a conveyor end, a sensor each being directed toward the conveyor end, a control unit for changing at least one of a discharge speed of the products from the storage unit and a conveying speed of the products on the conveyor elements, wherein each sensor is connected to the control unit.

9. The apparatus according to claim 8, wherein a sensor is provided for each conveyor element.

10. The apparatus according to claim 9, comprising a drive motor each connected to the control unit for the storage unit and the conveyor elements.

11. The apparatus according to claim 10, wherein the drive motors are configured to be switchable between the processing speed and an increased feeding speed.

12. The apparatus according to claim 8, comprising a supply sensor interacting with a supply end of the storage unit for determining a quantity of products available in the storage unit, wherein the supply sensor is connected to the control unit.

13. The apparatus according to claim 8, wherein the conveyor elements are connected through common control unit.

14. The apparatus according to claim 8, wherein the conveyor elements are arranged one above the other so as to form a meandering conveying path.

15. The apparatus according to claim 14, wherein the conveyor elements are comprised of circulating endless belts.

16. The apparatus according to claim 15, wherein ends of two conveyor elements are connected for conveying products by endless belts of at least one conveyor element, wherein the endless belts travel partially around guide rollers.

17. The apparatus according to claim 16, wherein a discharge end or an entry end of each conveyor element is constructed as a guide roller interacting with the partially circulating belts.

18. The apparatus according to claim 17, wherein an upstream last conveyor element is configured to feed the products to a collecting container of the processing machine where the products are stacked.

19. The apparatus according to claim 18, comprising a level sensor for controlling the processing speed of the products between the storage unit and the processing machine, wherein the level sensor is provided at the collecting container and upstream of the processing machine.

20. The apparatus according to claim 8, wherein the conveyor unit is configured for turning the products.

* * * * *